US005536422A

United States Patent [19]

Oldiges et al.

[11] Patent Number: 5,536,422

[45] Date of Patent: Jul. 16, 1996

[54] ANTI-SEIZE THREAD COMPOUND

[75] Inventors: Donald A. Oldiges, Cypress; Mathews George, Friendswood, both of Tex.

[73] Assignee: Jet-Lube, Inc., Houston, Tex.

[21] Appl. No.: 432,573

[22] Filed: May 1, 1995

[51] Int. Cl.[6] ..... C10M 125/00

[52] U.S. Cl. ..... 508/127; 508/122

[58] Field of Search ..... 252/29, 30, 22, 252/23

[56] References Cited

U.S. PATENT DOCUMENTS

| | | | |
|---|---|---|---|
| 1,586,087 | 5/1926 | Howe et al. | 252/23 |
| 2,419,144 | 4/1947 | Kelly | 252/23 |
| 2,537,629 | 1/1951 | Brown | 287/90 |
| 2,543,741 | 2/1951 | Zweifel | 252/26 |
| 2,581,301 | 1/1952 | Saywell | 252/26 |
| 2,754,266 | 7/1956 | Stegemeier et al. | 252/19 |
| 3,423,315 | 1/1969 | McCarthy et al. | 252/19 |
| 3,514,400 | 5/1970 | Hotten | 252/18 |
| 3,652,414 | 3/1972 | Bergeron | 252/19 |
| 3,652,415 | 3/1972 | Bergeron | 252/36 |
| 3,784,264 | 1/1974 | Jackson, Jr. | 308/8.2 |
| 3,785,785 | 1/1974 | Hodshire et al. | 252/12 |
| 3,801,506 | 4/1974 | Cross et al. | 252/40 |
| 3,843,528 | 10/1974 | Bailey et al. | 252/18 |
| 3,935,114 | 1/1976 | Donaho, Jr. | 252/18 |
| 4,155,860 | 5/1979 | Soucy | 252/26 |
| 4,256,811 | 3/1981 | Black | 428/562 |
| 4,329,238 | 5/1982 | Mitrofanova et al. | 252/12 |
| 4,358,384 | 11/1982 | Newcomb | 252/19 |
| 4,379,062 | 4/1983 | Preagaman | 252/26 |
| 4,525,287 | 6/1985 | Carstensen | 252/26 |
| 4,532,054 | 7/1985 | Johnson | 252/29 |
| 4,946,747 | 8/1990 | Bergmann et al. | 428/653 |
| 5,049,289 | 9/1991 | Jacobs | 252/22 |
| 5,085,700 | 2/1992 | Howard | 252/22 |
| 5,093,015 | 3/1992 | Oldiges | 252/23 |
| 5,180,509 | 1/1993 | Jacobs | 252/30 |
| 5,308,516 | 5/1994 | Chiddick | 252/30 |
| 5,427,698 | 6/1995 | Hirokawa et al. | 252/30 |

FOREIGN PATENT DOCUMENTS

| | | |
|---|---|---|
| 55082-196 | 12/1978 | Japan . |
| 775441 | 11/1978 | U.S.S.R. . |

OTHER PUBLICATIONS

API Bulletin 5A2, Sixth Edition, May 31, 1988, "Bulletin on Thread Compounds for Casting, Tubing, and Line Pipe," issued by American Petroleum Institute.

*Primary Examiner*—Ellen M. McAvoy
*Attorney, Agent, or Firm*—Robert W. Strozier

[57] ABSTRACT

The present invention discloses the use of nonmetallic, finely divided polymeric or natural fibers in anti-seize thread compound formulations for use on rotary shouldered, oilfield tubular good or tapered threaded connections. The addition of such fibers into formulas that do not contain metallic powders or flakes (typically utilized to provide the anti-galling properties) provides a measurable improvement in the galling and seize resistance properties. Therefore, the incorporation of such fibers provides a film strength improvement in environmentally responsible thread compound compositions, which previously would not provide the level of galling resistance to perform in severe applications such as oilfield directional or geothermal drilling.

20 Claims, No Drawings

ANTI-SEIZE THREAD COMPOUND

FIELD OF THE INVENTION

The present invention relates to anti-seize thread compound compositions containing non-metallic, synthetic or natural fibers, or mixtures thereof, for use in all manner of threaded connections and especially for use in oilfield tool joints, drill collars, casing, tubing, line pipe, flow lines and subsurface production tools.

More particularly, the present invention relates to thread compounds containing non-metallic finely divided polymeric or natural fibers, or mixtures thereof, for use in all manner of threaded connections including oilfield tool joints, drill collars, casing, tubing, line pipe, flow lines, subsurface production tools, oil processing equipment, and the like.

BACKGROUND OF THE INVENTION

Environmental regulations are restricting the use of thread compound products containing substantial amounts of metallic additives such as copper, lead, nickel, zinc, antimony or their salts for many applications. However, generally, thread compounds require these metallic agents to provide galling resistance and frictional properties to the thread compound products for optimum performance. As a result of the environmental restrictions and the removal or reduction in amount of these metallic agents, premature connection wear and failures are more prevalent due to the use of unrestricted agents in place of the metallic agents that have inferior galling resistance and frictional properties.

Oilfield thread forms require products with high film strength and specific coefficient of frictional properties. Because thread faces are often subjected to bearing stresses in excess of 50,000 psi, additional downhole connection engagement can result in bearing stresses capable of rupturing the protective "anti-seize" film. This additional engagement can result in wear, galling or complete connection failure.

Conventional anti-seize compounds work by placing a dissimilar metal or metallic containing film between two like substrates. The dissimilar metallic film provides a barrier between the two like substrates to protect against direct contact of the substrates which, under the pressure and heat of use, could result in fusing the substrates together. The fusion could then ultimately result in galling upon disengagement of the connection or in the worst case scenario, cause catastrophic failure of the connection.

In addition to restricting the use of metallic additives, many of the environmental regulations are restricting the use (or the potential introduction into the environment) of various organic fluid additives. These additives chemically react with the substrate to form softer compounds on the surface, which reduce the potential for galling. The organic fluid additives facing regulation include those containing antimony, barium, chlorine, lead, phosphorus, and/or zinc.

Products containing lower quantities of metallic and/or organic fluid additives have been formulated to perform in certain applications. Commercial products free of these additives, however, still lack the galling resistance and frictional properties required to perform optimally in severe applications.

U.S. Pat. No. 5,093,015 discloses an anti-seize composition including a suspending agent, a resin bonding system, a thinning agent, and a metallic flake. The anti-seize properties of this composition resulted from the bonding of the metallic flake to the threaded connection to interpose a dissimilar metal between threaded connection surfaces. Although this composition reduces metal loss into the environment, this composition still relies on a metallic agent to supply the anti-seize protection.

Thus, there is a need for an environmentally responsible lubricant that provides adequate anti-seize and frictional properties including the reduction of the additional downhole engagement of threaded connections used in oilfield drilling operations such as tool joints and drill collars. Specifically, there is a need for an environmentally responsible lubricant that does not contain heavy metals or potentially toxic organic fluid additives which can potentially end up in the drilling effluent or require hazardous waste classification.

SUMMARY OF THE INVENTION

The present invention provides an anti-seize thread compound including a thixotropic base material, one or more boundary lubricants, and one or more finely divided non-metallic fibers, where the thixotropic base material comprises a fluid thickened by a suspending agent. The anti-seize compound of the present invention preferably further includes an anti-wear additive system.

The present invention also provides a method for preparing the anti-seize thread compound where a finely divided high-tensile non-metallic fiber is first dispersed in a thixotropic base material where the thixotropic base material comprises a fluid thickened by a suspending agent or in the fluid portion of the thixotropic base material with mixing until the fiber is substantially dispersed in the thixotropic base material or fluid component thereof. The pre-dispersed fiber containing pre-mix may also be masterbatched into a fiber containing pre-mix concentrate for subsequent dilution in the remaining compound ingredients. The substantially dispersed fiber/thixotropic base material pre-mix is then added to the a premix including the thixotropic base material and one or more boundary lubricants and other optional ingredients and the premixes are mixed until a substantially homogenous thread compound results.

DETAILED DESCRIPTION OF THE INVENTION

The inventors have found that an anti-seize thread compound used to protect and allow the proper engagement of threaded connections by specified torques can be prepared free of metallic flake or metallic agents designed to form a dissimilar metallic film between the surfaces of threaded connection. The inventors achieved the new anti-seize thread compound by replacing the metal flake or metallic film forming agent with a non-metallic fiber. The inventors believe that the non-metallic fiber facilitates the formation of a non-metallic film on the surface of the threaded connection that acts to reduce stress induced galling or seizing in threaded connection during make-up and break-out.

The new compound is particularly preferred for use in oil, mining or water well drilling operations. The new compound comprises a thixotropic base material, one or more boundary lubricants and finely divided fiber to generate a product that is free of metallic film forming agents or potentially toxic organic additives and provides maximum protection from connection wear, galling, and seizing. Preferably, the new compound also includes an anti-wear additive system comprising one or more finely divided mineral additives designed to reduce surface wear during make-up and breakout.

The incorporation of finely divided polymeric or natural fibers into the thread compounds of the present invention have provided a measurable increase in the film strength/galling resistance.

The thixotropic base material useful in the compounds of the present invention include any material that may be used to uniformly suspend the other components of the thread compounds of the present invention and the exact nature of the thixotropic base material is not thought to be critical to the film forming and ant-seize properties of the present thread compounds. Suitable thixotropic base materials of the present invention comprise one or more fluids and one or more suspending agents.

Suitable fluids include, without limitation, synthetic fluids, petroleum based fluids, natural fluids and mixtures thereof. The fluids of preference for use in the thread compounds of the present invention have viscosities ranging from about 5 to about 600 centistokes. Preferred fluids include, without limitation, polyalphaolefins, polybutenes, polyolesters, vegetable oils, animal oils, other essential oil, and mixtures thereof.

Suitable polyalphaolefins (PAOs) include, without limitation, polyethylenes, polypropylenes, polybutenes, polypentenes, polyhexenes, polyheptenes, higher PAOs, copolymers thereof, and mixtures thereof. Preferred PAOs include PAOs sold by Mobil Chemical Company as SHF fluids and PAOs sold formerly by Ethyl Corporation under the name ETHYLFLO and currently by Albemarle Corporation under the trade name Durasyn. Such fluids include those specified as ETYHLFLO 162, 164, 166, 168, 170, 174, and 180. Particularly preferred PAOs include bends of about 56% of ETHYLFLO now Durasyn 174 and about 44% of ETHYLFLO now Durasyn 168.

Preferred polybutenes include, without limitation, those sold by Amoco Chemical Company and Exxon Chemical Company under the trade names INDOPOL and PARAPOL, respectively. Particularly preferred polybutenes include Amoco's INDOPOL 100.

Preferred polyolester include, without limitation, neopentyl glycols, trimethylolpropanes, pentaerythriols, dipentaerythritols, and diesters such as dioctylsebacate (DOS), diactylazelate (DOZ), and dioctyladipate.

Preferred petroleum based fluids include, without limitation, white mineral oils, paraffinic oils, and medium-viscosity-index (MVI) naphthenic oils having viscosities ranging from about 5 to about 600 centistokes at 40° C. Preferred white mineral oils include those sold by Witco Corporation, Arco Chemical Company, PSI, and Penreco. Preferred paraffinic oils include solvent neutral oils available from Exxon Chemical Company, high-viscosity-index (HVI) neutral oils available from Shell Chemical Company, and solvent treated neutral oils available from Arco Chemical Company. Preferred MVI naphthenic oils include solvent extracted coastal pale oils available from Exxon Chemical Company, MVI extracted/acid treated oils available from Shell Chemical Company, and naphthenic oils sold under the names Hydro-Cal and Calsol by Calumet.

Preferred vegetable oils include, without limitation, castor oils, corn oil, olive oil, sunflower oil, sesame oil, peanut oil, other vegetable oils, modified vegetable oils such as crosslinked castor oils and the like, and mixtures thereof. Preferred animal oils include, without limitation, tallow, mink oil, lard, other animal oils, and mixtures thereof. Other essential oils will work as well. Of course, mixtures of all the above identified oils can be used as well.

Suitable suspending agents include, without limitation, suspending agents conventionally used in paints and thread compound such as silica, clay, organic thickeners, or mixtures thereof. Suitable organic thickeners can include, without limitation, metal or mineral soaps or complex soaps, polyureas, other polymers, and mixtures thereof. Preferred soaps or soap complexes include aluminum benzoate-stearate complexes, aluminum benzoate-behenate-arachidate complexes, lithium azelate-stearate complexes, lithium sebecate-stearate complexes, lithium adepate-stearate complexes, calcium acetate-stearate complexes, calcium sulfonate-stearate complexes, but other aluminum, calcium, lithium, or other mineral soaps or complex soaps and mixtures thereof can equally well be used.

Preferred organic thickener thixotropic base materials include, without limitation, one or more metallic or mineral soap or soap complex thickened hydrocarbon fluids. Aluminum, calcium, lithium complex greases or mixtures thereof are particularly preferred as they generally have high melt points and excellent water resistance.

Generally, organic thickener thixotropic base materials comprise from about 2 wt. % to about 15 wt. % of one or more soaps and/or soap complexes and from about 98 wt. % to about 85 wt. % of one or more oils as described below. The preferred requirement for the thixotropic base material is that material has a sufficient viscosity to yield a final base oil viscosity in the range of about 100 to about 250 centistokes at 40° C. Of course, the final composition viscosity for the thixotropic base will depend on the amount of the base used in the formulation, the viscosity of the other ingredients, and on the thickening tendencies of the solid materials. However, in general, because the thixotropic base comprises the majority of the composition, the viscosity will be more or less controlled by the viscosity of the thixotropic base material.

Water resistance is particularly important in oilfield, mining or water well drilling operations. Aluminum complex thickened hydrocarbon fluids are particularly preferred as they generally have a high melt point, wet metal adhesion, superior water resistance and can be formulated to conform to food grade requirements so are classified as nonhazardous.

The boundary lubricants suitable for use in the present invention include, without limitation, graphites, calcium compounds such as carbonates, sulfates, acetates, fluorides, etc., other nonabrasive mineral compounds such as silicates, acetates, carbonates, sulfates, fluorides, etc., and mixtures thereof.

The finely divided fibers suitable for use in the present invention include, without limitation, synthetic polymeric fibers, non-abrasive mineral fibers, natural fibers, and mixtures thereof. Suitable synthetic polymeric fibers include, without limitation: polyamides such as nylon, kevlarTM, aramid, and the like; polyimides; polyesters such as PET and the like, polycarbonates, carbon and carboneous, and the like and mixtures thereof. Suitable natural fibers include cellulose such as cotton and the like, modified cellulose and the like and mixtures thereof. Suitable mineral fibers include, without limitation, silicaceous mineral fibers and the like.

The fibers are thought to interlock under shear to produce a boundary lubricant retaining film on the surface of the threaded connections. This film is thought to result in a thread compound with improved galling and seize resistance.

The present invention can preferably further includes an anti-wear additive system. Suitable anti-wear additives include, without limitation, molybdenum disulfide, boron nitride, bismuth naphthenate, organic sulfur additives, and mixtures thereof.

The present invention may further contain other conventional additives such as rust inhibitors, antioxidants, and corrosion inhibitors. These additional additives can be blended into the thixotropic base material prior to compound preparation or added during compound preparation. Such additives are added to the thixotropic base materials or to final compositions using mixing procedures well-known in the art.

The anti-seize composition of the present invention may be prepared by blending the ingredients together using mixing procedures well-known in the art. The components must be substantially homogeneously blended to provide optimum film integrity. For smaller quantities, blending may take place in a pot or drum. For large quantities, the composition may be blended by combining the components in a large kettle mixer and mixing them together to produce a substantially homogeneous blend.

The present thread compounds can preferably include from about 40% to about 80% by weight of a thixotropic base material, from about 5% to about 40% by weight of one or more boundary lubricants and about 0.1% to about 10% by weight of one or more finely divided non-metallic fibers. Additionally, the thread compounds of the present invention can include up to about 12% by weight of an anti-wear additive system and up to about 5% by weight of an anti-degradant system. The anti-degradant system can include an antioxidant, an rust inhibitor, and/or corrosion inhibitor.

More particularly, the present thread compounds can include from about 50% to about 80% by weight of a thixotropic base material, from about 10% to about 30% by weight of one or more boundary lubricants, and from about 0.2% to about 5% by weight of one or more finely divided fibers. Again, the present invention can include up to about 10% by weight an anti-wear additive system and up to about 4% by weight of an anti-degradant system.

More especially, the present thread compounds can include from about 60% to about 80% by weight of a thixotropic base material, from about 15% to about 25% by weight of one or more boundary lubricants, and from about 0.2% to about 3% by weight of one or more finely divided fibers. Again, the present invention can include up to about 8% by weight an anti-wear additive system and up to about 3% by weight of an anti-degradant system.

The thread compounds of the present invention are prepared by mixing the ingredients in an appropriate mixer such as a vertical blender or other equipment well-known in the art for mixing lubricants. Of particular importance, is to ensure that the non-metallic, finely divided fiber, which is generally available in a pulp form, is adequately dispersed in the compound. The necessity for adequate dispersion of the fiber normally requires that the fiber be pre-mixed in the thixotropic base material. Thus, the fiber is first broken by hand into small clumps and then mixed into the thixotropic base material in premix step. When mixing is done in a conventional vertical blender, about 4 wt. % of fiber is mixed with 96 wt. % of the thixotropic base material. The mixing is performed as a moderate mix speed of about 45 rpm with half of the thixotropic base for about 15 minutes and then at a high speed, usually at the highest practical speed of the mixer, for another at least 15 minutes. The pre-mix is then tested for fiber dispersion. If no visible clumps are seen, then the remaining half of the thixotropic base is added and mixed for another about 15 minutes. The main purpose of this pre-mix step is to ensure that the fiber is substantially and uniformly distributed throughout the final thread compound so that film formation and integrity is optimized. Of course, the pre-mix can also be done in colloidal mixers and other types of apparatus. Additionally, the pre-mix can be pre-strained to remove any non-dispersed fiber.

The fiber containing pre-mix is then added to the other ingredients in a standard blender, usually vertical. The compound is mixed for at least 30 minutes after ingredient addition to ensure homogeneity. Of course, shorter and longer mixing times can be used depending on the mixer speed and type.

When compared to the conventional thread compounds containing metallic solids and/or toxic organic extreme pressure additives the formulas above provide equivalent frictional properties. That is, utilizing standard torque values the connections will be engaged within the optimum range. These formulas stick to wet or oily threads, are extremely water resistant, brush over a wide temperature range, are environmentally responsible and provide high film strength, anti-galling, and anti-seize properties. Although the compounds of the above examples contain additives for rust, corrosion and oxidation resistance, those that do not are within the scope of the disclosed invention. The following examples illustrate the present invention. It must be noted that the proportions of components can vary. Selection of different thixotropic base materials, boundary lubricants, finely divided synthetic or natural fibers, anti-wear additives, rust, corrosion and oxidation inhibitors can readily be made. The examples are illustrative, therefore, should not be construed to limit the scope of the present invention.

EXAMPLE 1

This example describes the preparation of a lubricant of the present invention containing Kevlar as the finely divided fiber. The example describes the preparation of the thread compound and its testing. The compound was prepared by adding a pre-mix fiber grease to the other ingredients in a final mix step.

To a drum, 48.08 wt. % of an aluminum complex grease was added along with 3.84 wt. % of hand broken down Kevlar pulp. The aluminum complex grease was prepared by mixing 6.4 wt. % of aluminum benzoate-stearate complex with 93.6 wt. % of an MVI naphthenic oil to form the aluminum complex grease, the thixotropic base material. MVI is an industrial standard grade of naphthenic oil available from Exxon Chemical Company, Shell Chemical Company, or Calumet. The drum was secured to the base of a vertical blender. The blender blades were cleaned and lowered into the drum. The composition was then mixed at 45 rpm for at least 15 minutes. Mixing was stopped and the blender speed was reset at its highest practical speed and mixing was continued until the Kevlar pulp was thoroughly dispersed as evidence visually by the absence of small clumps of Kevlar pulp. The mixer was stopped and a sample taken to test for Kevlar dispersion. (If lumps are detected, mixing is continued until no visible lumps are detected.) The mixer was stopped and another 48.08 wt. % of the aluminum complex grease was added to the drum. The mixer was turned on at a lower speed and mixed for an additional 15 minutes to disperse the added aluminum complex grease. This pre-mix constituted a pre-dispersed kevlar pulp, aluminum complex grease. Masterbatches of this fiber grease can be prepared and stored for subsequent use in mass production.

To a large blender, was added 55.2 wt. % of the aluminum complex grease, the thixotropic agent, available from Jet-Lube, Inc. of Houston, Tex. and prepared as described above. The mixer and pump of the blender were started. To the aluminum complex grease were added 1.0 wt. % of Vanlube 829, an anti-degradant, 5.1 wt. % of mica, a ternary boundary lubricant, 3.4 wt. % of fine molybdenum disulfide, an anti-wear additive, 8.0 wt. % of calcium carbonate, an secondary boundary lubricant, 1.0 wt. % of calcium sulfonate available from King Industries, a rust inhibitor, 0.3 wt. % of mercapta diathiazole available from Ethyl Chemical Corporation, a corrosion inhibitor, and 0.5 wt. % alkylated diphenylamine available from RT Vanderbilt, an oxidation inhibitor. To this mixture, was added 7.8 wt. % of the fiber grease pre-mix described above. The fiber grease drum was then flushed with 7.5 wt. % of the aluminum complex grease to clean the drum and ensure addition of all of the fiber grease. 10.2 wt. % of graphite, a primary boundary lubricant, were then added to the composition and the resulting thread compound was mixed for at least 30 minutes. The resulting thread composition contained 69.2 wt. % of the aluminum complex base, the thixotropic base material, 10.2 wt. % of powdered graphite available from Cummings-Moore, the primary boundary lubricant, 8.0 wt. % of calcium carbonate from Georgia Marble, a secondary boundary lubricant, 5.1 wt. % of mica from Spartan Minerals, a ternary boundary lubricant, 4.3 wt. % of molybdenum disulfide available from Climax Molybdenum, an anti-wear additive, 0.5 wt. % of Kevlar pulp, the polymeric fiber, 1.0 wt. % of calcium sulfonate available from King Industries, a rust inhibitor, 0.3 wt. % of mercapta diathiazole available from Ethyl Chemical Corporation, a corrosion inhibitor, 1.0 wt. % of Vanlube 826, an anti-degradant, and 0.5 wt. % alkylated diphenylamine available from RT Vanderbilt, an oxidation inhibitor.

Table 1 lists certain characteristics for the anti-seize thread compound of Example 1.

TABLE 1

| | |
|---|---|
| Dropping Point | >525° F. |
| Specific Gravity | 1.10 |
| Oil Separation | <3.0 |
| Flash Point | >430° F. |
| NLGI Grade | 1½ |
| Copper Strip Corrosion | 1A |
| 4-Ball Weld Point | >1000 kgf |

COMPARATIVE EXAMPLE 1

This comparative example describes the preparation of a conventional anti-seize compound absent the finely divided Kevlar fiber. The example describes the preparation of the conventional compound and its testing.

The thread compound of this examples has prepared by the procedure of Example 1 except that the fiber grease pre-mix was not used and all but the 7.5 wt. % of the aluminum complex base was initially added to the blender. The resulting non-fiber thread compound was 69.7 wt. % of Aluminum Benzoate Stearate Complex available from Jet-Lube, Inc. of Houston, Tex., a thixotropic agent, 10.2 wt. % of Powdered Graphite available from Cummings-Moore, a Primary Boundary Lubricant, 8.0 wt. % of Calcium Carbonate from Georgia Marble, a Secondary Boundary Lubricant, 5.1 wt. % of Mica from Spartan Minerals, a Trainer Boundary Lubricant, 4.3 wt. % of Molybdenum Disulfide available from Climax Molybdenum, a Anti-wear Additive, 1.0 wt. % of Calcium Sulfonate available from King Industries, a Rust Inhibitor, 0.3 wt. % of Mercapta Diathiazole available from Ethyl Chemical Corporation, a Corrosion Inhibitor, 1.0 wt. % of Vanlube 826, an anti-degradant, and 0.5 wt. % Alkylated Diphenylamine available from RT Vanderbilt, an Oxidation Inhibitor. This composition was made on a smaller scale of about 1 to 3 lbs for comparative testing purposes.

Table 1C lists certain characteristics for the anti-seize thread compound of Example 1.

TABLE 1C

| | |
|---|---|
| Dropping Point | >525° F. |
| Specific Gravity | 1.10 |
| Oil Separation | <3.0 |
| Flash Point | >430° F. |
| NLGI Grade | 1½ |
| Copper Strip Corrosion | 1A |
| 4-Ball Weld Point | 620/800 kgf |

EXAMPLE 2

This example describes the preparation of a lubricant of the present invention containing kevlar fiber as the finely divided fiber. The example describes the preparation of the lubricant and its testing.

This thread compound was mixed in a procedure analogous to Example 1 including the preparation of a fiber grease pre-mix except a lithium complex grease base material was used. The lithium complex grease was prepared by mixing 9 wt. % of a dilithium azelate-lithium 12-hydroxystearate complex with 91 wt. % of a oil blend comprising 20 wt. % of an HVI paraffinic oil and 80 wt. % of an MVI naphthenic oil. The resulting composition was 62.6 wt. % of Lithium Complex Grease - Jet-Lube, Inc., a Thixotropic Base Material, 22.4 wt. % of Powdered Graphite - Superior Graphite, a Primary Boundary Lubricant, 11.2 wt. % of Mica - Spartan Minerals Corporation, a Secondary Boundary Lubricant, 1.0 wt. % of Kevlar pulp available form Du Pont, a Synthetic Polymeric Fiber, 2.0 wt. % of Organosulfur - RT Vanderbilt, an Anti-wear Additive, 0.5 wt. % of Alkylated Diphenylamine - RT Vanderbilt, an Antioxidant, and 0.3 wt. % of Mercapto Diathiazole - Ethyl Chemical, a Corrosion Inhibitor.

Table 2 lists certain characteristics of the anti-seize thread compound in Example 2.

TABLE 2

| | |
|---|---|
| Dropping Point | >525° F. |
| Specific Gravity | 1.10 |
| Oil Separation | <3.0 |
| Flash Point | >430° F. |
| NLGI Grade | 1½ |
| Copper Strip Corrosion | 1A |
| 4-Ball Weld Point | 620/800 kgf |

COMPARATIVE EXAMPLE 2

This comparative example describes the preparation of a conventional thread compound absent the finely divided kevlar fiber for Example 2. The example describes the preparation of the lubricant and its testing.

The thread compound of this examples was prepared by the procedure of Example 1 except that the fiber grease pre-mix was not made. The resulting non-fiber thread compound was 63.1 wt. % of Lithium Complex Grease - Jet-Lube, Inc., a Thixotropic Base Material, 22.4 wt. % of Powdered Graphite - Superior Graphite, a Primary Boundary Lubricant, 11.2 wt. % of Mica - Spartan Minerals Corporation, a Secondary Boundary Lubricant, 2.0 wt. % of Organosulfur - RT Vanderbilt, an Anti-wear Additive, 0.5 wt. % of Alkylated Diphenylamine - RT Vanderbilt, an Antioxidant, and 0.3 wt. % of Mercapto Diathiazole - Ethyl Chemical, a Corrosion Inhibitor.

Table 2C lists certain characteristics of the anti-seize thread compound in Example 2.

TABLE 2C

| | |
|---|---|
| Dropping Point | >525° F. |
| Specific Gravity | 1.10 |
| Oil Separation | <3.0 |
| Flash Point | >430° F. |
| NLGI Grade | 1½ |
| Copper Strip Corrosion | 1A |
| 4-Ball Weld Point | 620/800 kgf |

Comparing the properties of the thread compounds of Examples 1 and 2 to their respective comparative examples, one can readily see that the 4-Ball Weld Point test results were improved to a value of greater than a 1000 kgf from a 800 kgf initial and a 620 kgf final value for the comparative compounds. This substantial increase in weld point makes these non-metal containing anti-seize compositions an environmentally friendly alternative to the anti-seize compositions that contain large amounts of metal or metallic flake.

Additional advantages and modifications will readily occur to those skilled in the art. The invention in its broader aspects is therefore, not limited to the specific details and the illustrative examples as shown and described.

We claim:

1. An anti-seize thread compound including one or more thixotropic base materials, one or more boundary lubricants, and one or more finely divided non-metallic fibers, where the thixotropic base material comprises one or more fluids and one or more suspending agents.

2. The anti-seize compound of claim 1, further comprising an anti-wear additive system and an anti-degradant additive system.

3. The anti-seize compound of claim 1, wherein: the fluid comprises a hydrocarbon fluid, a synthetic fluid, or mixtures thereof; the suspending agent comprises a silica, a clay, an organic thickener, or mixtures thereof; the boundary lubricant comprises a graphite, a calcium compound, a silicate, an acetate, a carbonate, a sulfate, a fluoride, or mixtures thereof; and the fiber comprises a synthetic polymer fiber, natural fiber, or mixtures thereof.

4. The anti-seize compound of claim 2, wherein: the fluid comprises a hydrocarbon fluid, a synthetic fluid, or mixtures thereof; the suspending agent comprises a silica, a clay, an organic thickener, or mixtures thereof; the boundary lubricant comprises a graphite, a calcium compound, a silicate, an acetate, a carbonate, a sulfate, a fluoride, or mixtures thereof; the fiber comprises a synthetic polymeric fiber, a natural fiber, a non-abrasive mineral fiber, or mixtures thereof; the anti-wear additive system comprises molybdenum disulfide, boron nitride, bismuth naphthenate, organic sulfur additives, or mixtures thereof; and the anti-degradant additive system comprises one or more rust inhibitors, one or more antioxidants, and one or more corrosion inhibitors.

5. The anti-seize compound of claim 4, wherein the synthetic fibers are selected from the group consisting of polyamide fibers, polyimide fibers, polyester fibers, polycarbonate fibers, carbon and carboneous fibers, and mixtures thereof and the natural fibers are selected from the group of cellulose fibers, modified cellulose fibers, and mixtures thereof.

6. An anti-seize thread compound comprising from about 40% to about 80% by weight of a thixotropic base material, from about 5% to about 40% by weight of one or more boundary lubricants and from about 0.1% to about 10% by weight of one or more finely divided non-metallic fibers.

7. The anti-seize thread compound of claim 6, further comprising up to about 12% by weight of an anti-wear additive system and up to about 5% by weight of an anti-degradant system.

8. The anti-seize thread compound of claim 6, wherein: the fluid comprises a hydrocarbon fluid, a synthetic fluid, or mixtures thereof; the suspending agent comprises a silica, a clay, an organic thickeners, or mixtures thereof; the boundary lubricant comprises a graphite, a calcium compound, a silicate, an acetate, a carbonate, a sulfate, a fluoride, or mixtures thereof; and the fiber comprises a synthetic polymer fiber, natural fiber, or mixtures thereof.

9. The anti-seize compound of claim 7, wherein: the fluid comprises a hydrocarbon fluid, a synthetic fluid, or mixtures thereof; the suspending agent comprises a silica, a clay, an organic thickeners, or mixtures thereof; the boundary lubricant comprises a graphite, a calcium compound, a silicate, an acetate, a carbonate, a sulfate, a fluoride, or mixtures thereof; the fiber comprises a synthetic polymeric fiber, natural fiber, or mixtures thereof; the anti-wear additive system comprises molybdenum disulfide, boron nitride, bismuth naphthenate, organic sulfur additives, or mixtures thereof; and the anti-degradant additive system comprises one or more rust inhibitors, one or more antioxidants, and one or more corrosion inhibitors.

10. The anti-seize thread compound of claim 6, comprising from about 50% to about 80% by weight of a thixotropic base material, from about 10% to about 30% by weight of one or more boundary lubricants, and from about 0.2% to about 5% by weight of one or more finely divided fibers up to about 10% by weight an anti-wear additive system and up to about 4% by weight of an anti-degradant system.

11. The anti-seize thread compound of claim 6, comprising from about 60% to about 80% by weight of a thixotropic base material, from about 15% to about 25% by weight of one or more boundary lubricants, from about 0.2% to about 3% by weight of one or more finely divided fibers, up to about 8% by weight an anti-wear additive system, and up to about 3% by weight of an anti-degradant system.

12. A method for making a non-metallic, anti-seize thread compound comprising the steps of:

a. mixing one or more thixotropic base materials and one or more finely divided, non-metallic fibers to form a highly dispersed fiber grease pre-mix designed to disperse the fiber in the thixotropic base material absent visible fiber clumps, where the thixotropic base materials comprise one or more fluids and one or more suspending agents;

b. adding with mixing the fiber grease of step (a) to the same or different thixotropic base material of step (a) and one or more boundary lubricants to form a thread anti-seize compound;

c. mixing the anti-seize compound until a homogenous composition results.

13. The method of claim 12, wherein the anti-seize compound of step (b) further includes an anti-wear additive system and an anti-degradant system.

14. The method of claim 12, wherein the fiber grease comprises from about 98 wt. % to about 85 wt. % of one or more thixotropic base materials and from about 2 wt. % to about 15 wt. % of one or more non-metallic fiber.

15. The method of claim 12, wherein the anti-seize compound comprises from about 40% to about 80% by weight of a thixotropic base material, from about 5% to about 40% by weight of one or more boundary lubricants and from about 0.1% to about 10% by weight of one or more finely divided non-metallic fibers.

16. The method of claim 12, wherein the anti-seize compound comprises up to about 12% by weight of an anti-wear additive system and up to about 5% by weight of an anti-degradant system.

17. The method of claim 16, wherein the anti-seize compound comprises from about 50% to about 80% by weight of a thixotropic base material, from about 10% to about 30% by weight of one or more boundary lubricants, and from about 0.2% to about 5% by weight of one or more finely divided fibers up to about 10% by weight an anti-wear additive system and up to about 4% by weight of an anti-degradant system.

18. The method of claim 16, wherein the anti-seize compound comprises from about 60% to about 80% by weight of a thixotropic base material, from about 15% to about 25% by weight of one or more boundary lubricants, from about 0.2% to about 3% by weight of one or more finely divided fibers, up to about 8% by weight an anti-wear additive system, and up to about 3% by weight of an anti-degradant system.

19. The method of claim 12, wherein: the fluid comprises a hydrocarbon fluid, a synthetic fluid, or mixtures thereof; the suspending agent comprises a silica, a clay, an organic thickeners, or mixtures thereof; the boundary lubricant comprises a graphite, a calcium compound, a silicate, an acetate, a carbonate, a sulfate, a fluoride, or mixtures thereof; and the fiber comprises a synthetic polymer fiber, natural fiber, or mixtures thereof.

20. The method of claim 13, wherein: the fluid comprises a hydrocarbon fluid, a synthetic fluid, or mixtures thereof; the suspending agent comprises a silica, a clay, an organic thickeners, or mixtures thereof; the boundary lubricant comprises a graphite, a calcium compound, a silicate, an acetate, a carbonate, a sulfate, a fluoride, or mixtures thereof; the fiber comprises a synthetic polymeric fiber, natural fiber, or mixtures thereof; the anti-wear additive system comprises molybdenum disulfide, boron nitride, bismuth naphthenate, organic sulfur additives, or mixtures thereof; and the anti-degradant additive system comprises one or more rust inhibitors, one or more antioxidants, and one or more corrosion inhibitors.

* * * * *